US007152544B2

(12) United States Patent
Kryska et al.

(10) Patent No.: US 7,152,544 B2
(45) Date of Patent: Dec. 26, 2006

(54) BALLAST SYSTEM FOR TENSION LEG PLATFORM

(75) Inventors: Terrence Kryska, Bellville, TX (US); David E. Chaplin, Magnolia, TX (US)

(73) Assignees: Modec International, L.L.C., Houston, TX (US); Sea Engineering Associates, Inc., Katy, TX (US)

( * ) Notice: Subject to any disclaimer, the term of this patent is extended or adjusted under 35 U.S.C. 154(b) by 0 days.

(21) Appl. No.: 11/040,406

(22) Filed: Jan. 21, 2005

(65) Prior Publication Data

US 2005/0160958 A1 Jul. 28, 2005

Related U.S. Application Data

(60) Provisional application No. 60/547,952, filed on Feb. 24, 2004, provisional application No. 60/539,067, filed on Jan. 22, 2004.

(51) Int. Cl.
*B63B 39/03* (2006.01)

(52) U.S. Cl. ..... 114/125

(58) Field of Classification Search ..... 114/125
See application file for complete search history.

(56) References Cited

U.S. PATENT DOCUMENTS 3,207,111 A * 9/1965 Gilberty ..... 114/121
4,276,849 A 7/1981 Bloxham
4,314,519 A 2/1982 Yunoki et al.
5,135,327 A 8/1992 White et al.
6,378,451 B1 4/2002 Wetch et al.
6,830,413 B1 12/2004 Wybro et al.
2002/0090270 A1* 7/2002 Malcolm et al. ..... 405/195.1

* cited by examiner

*Primary Examiner*—Stephen Avila
(74) *Attorney, Agent, or Firm*—Gary L. Bush; Andrews Kurth LLP

(57) ABSTRACT

An apparatus and method for ballasting and de-ballasting a vessel having a hull with several watertight ballast compartments. In a first embodiment, a pressure tank is isolatably and fluidly coupled to a common sea chest, to the atmosphere, to ballast compartments via a distribution manifold, and to a source of compressed gas. The pressure tank is first vented and filled with water from the sea chest, then isolated. The filled tank is then coupled to a ballast tank and the source of compressed gas, which displaces water from the tank to the ballast compartment. In other embodiments, ballasting is by venting and flooding compartments using individual sea chests located within the ballast compartments or a firewater system. For de-ballasting, compressed gas displaces ballast water through overboard discharges, through the common sea chest via the pressure tank, or through individual sea chests located within the ballast compartments.

17 Claims, 7 Drawing Sheets

BALLAST SYSTEM FOR TENSION LEG PLATFORM

CROSS REFERENCE TO RELATED APPLICATION

This application is based upon provisional application 60/539,067 filed on Jan. 22, 2004 and provisional application 60/547,952 filed on Feb. 24, 2004, the priorities of which are claimed.

BACKGROUND OF THE INVENTION

1. Field of the Invention

This invention relates generally to tension leg platforms used in the offshore oil and gas production industry and specifically to a method and system for ballasting and de-ballasting a tension leg platform for towing, installation (lock-off to tendons) and use during in-service operation of the platform.

2. Description of the Prior Art

Tension leg platforms (TLP) are generally used offshore in deep water for the production of hydrocarbons. A typical TLP has a horizontal pontoon hull structure and vertical columns supporting a platform. The hull structure provides buoyancy to the columns and platform. The TLP is anchored by tendons to pilings in the ocean floor, and it is held stationary by buoyancy-induced tension in the tendons.

The hull is generally divided into several watertight compartments in order to meet stability requirements during installation ballasting. TLPs are de-ballasted during installation to tension the tendons to maintain the platform within design limits at all times. The de-ballasting operation is preferably rapid to minimize the time during which the resonant frequency of the TLP equals the natural period of the surrounding water. In order to rapidly de-ballast, TLPs are generally equipped with one or more pump rooms containing high-capacity pumps. However, once installation is complete, only minor in-service trim adjustments are made, so the pumps are no longer subjected to high-capacity requirements.

3. Identification of Features Provided by Some Embodiments of the Invention

A primary object of the invention is to minimize the capital cost of the installed high capacity pumps which pump and distribute ballast water into the hull.

Another object of the system is to provide a method for rapidly achieving installation draft by providing a method of rapid flooding of the ballast tanks.

Another object of the system is to provide a method to limit ratcheting of the slip mechanism when locking off the tendons to the hull.

SUMMARY OF THE INVENTION

The objects identified above, as well as other features of the invention are incorporated in an apparatus and method for ballasting and de-ballasting a tension leg platform (TLP) or other vessel. The TLP includes a hull that provides buoyancy to tension the tendons and to support the columns and elevated topside decks. The hull generally contains both permanent and temporary ballast tanks and a distribution system for the ballast water. In the TLP used to illustrate the ballasting/de-ballasting system and method, the hull tanks form a center base section radiating outward to the four tendon support structures. All tanks preferably have separate vents to the atmosphere.

A first embodiment uses a source of compressed gas, preferably from one or more high capacity air compressors to distribute water to the hull tanks through a manifold system and a single pressure tank contained in the hull. The pressure tank is isolatably connected to a sea chest and has valved vent, water and air inlets to allow for filling, evacuating, pressurizing and de-pressuring the tank. For ballasting, the pressure tank is filled with seawater by opening the vent and sea chest lines. Thus, the pressure tank provides the source of ballast water. Next, the pressure tank vent and sea chest lines are isolated, and the pressure tank is aligned to fill a desired ballast compartment. The high capacity air compressor displaces the water in the pressure tank to the selected ballast compartment. The rate of ballasting is controlled by the tank volume and mass flow rate of gas supplied for tank evacuation. The system may optionally use compressed gas via optional de-ballast gas lines plumbed between the source of compressed gas and the ballast compartment to displace ballast from the ballast compartment out the sea chest via the pressure tank, or, alternatively, de-ballast and ballast transfer between tanks may be accomplished using optional moderate capacity centrifugal pumps and separate return lines.

For the TLP configuration described herein, the pressure tank supplies water to a manifold with four supply headers. The supply headers subdivide the ballast tanks into four groups composed of opposing tanks in each quadrant and the center base segment. Each header preferably has a remotely actuated valve for isolation, and each tank preferably has a remotely actuated ballast compartment isolation valve for isolation for ballast flow. The four supply headers are manifolded together to supply the bilge and ballast transfer pumps suctions, if so equipped. The discharges from the pumps are tied into a return manifold that returns to the individual tanks via four return headers or can be used to discharge the water overboard through a valved overboard discharge fitting.

In a second embodiment, individual sea chests located in the individual ballast tanks replace the single pressure tank as the source of ballast water. The individual tanks each have valved vent, sea chest and air inlets to allow for filling, evacuating, pressurizing and de-pressuring the tank. Additionally, the ballast tanks may be manifolded together to allow alternative means to fill or evacuate the tanks, including ballast transfer between tanks. All tanks preferably have separate vents to the atmosphere. For de-ballasting, the second embodiment uses a source of compressed gas, preferably one or more high capacity air compressors, to displace ballast water in the ballast tanks overboard, either through the manifold system which is tied to an overboard discharge or through the sea chests located within the individual tanks. The rate of de-ballasting is controlled by the mass flow rate of air supplied for tank evacuation. For ballasting, water is supplied to the individual tanks either directly by the sea chests under sea pressure (by simply opening sea chest isolation and vent valves) or by the manifold system which is supplied by firewater pumps, seawater lift pumps or similar supply. For instance, ballast water may be supplied from an external source such as from an installation vessel. The sea chest, manifold, air supply and vent isolation valves are all preferably remotely operable.

BRIEF DESCRIPTION OF THE DRAWINGS

The invention is described in detail hereinafter by reference to embodiments represented in the accompanying figures, in which.

DESCRIPTION OF THE PREFERRED EMBODIMENT OF THE INVENTION

Figure 1:
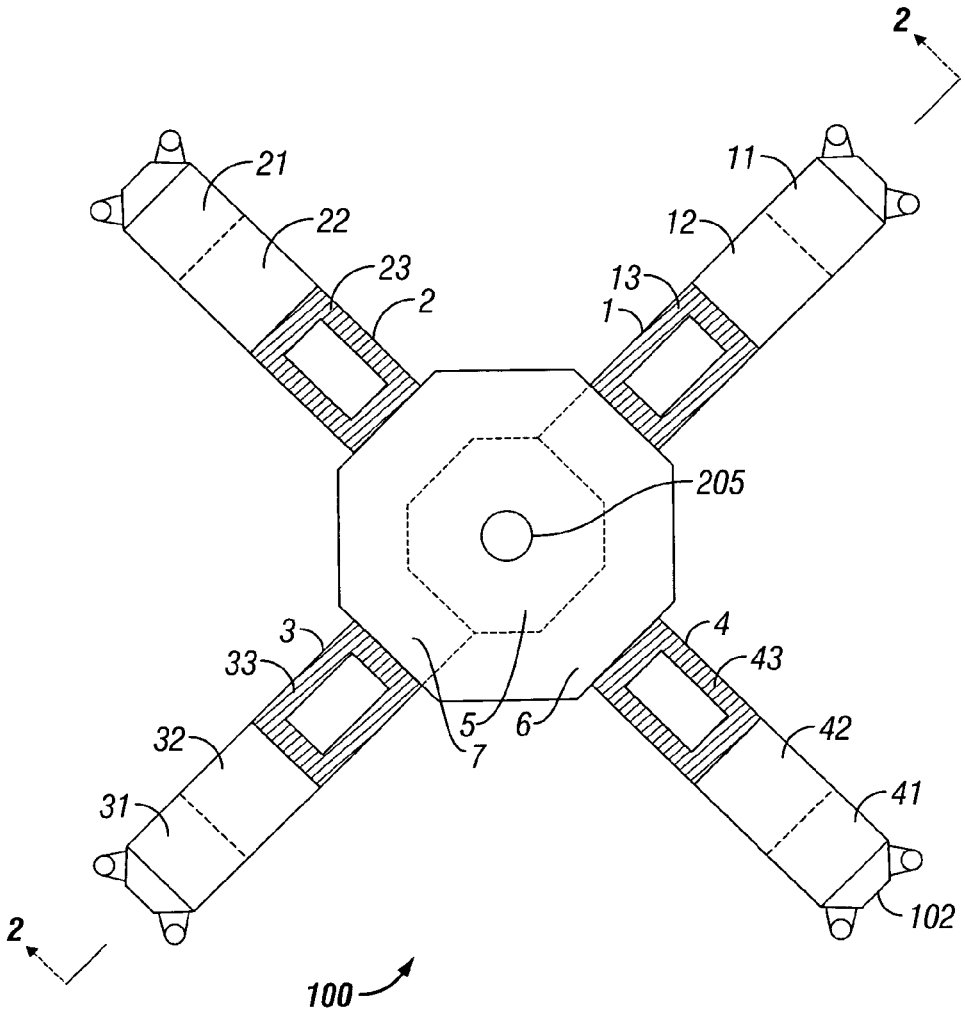
FIG. 1 is a top view cross section of a TLP viewed along the lines 1—1 of FIG. 2 showing the internal ballast tank structure of a typical TLP and a pressuretank/common ballasting sea chest according to a first embodiment of the invention.

As shown in FIG. 1, a first embodiment of the ballast and de-ballast system according to the invention is preferably employed in a tension leg platform (TLP) 100 having a hull 102 and a number of columns 1, 2, 3, 4 extending upwardly therefrom and supporting a deck 104. The hull 102 has any number of internal ballast tanks but is illustrated with fifteen internal ballast tanks. There are four permanent ballast tanks 11, 21, 31, 41 that are the most outboard tanks in the hull 102. There are eleven tanks within the hull 102 used only temporarily for towing and installation of the TLP to the tendons: Four of these temporary ballast tanks 12, 22, 32, 42 are located immediately inboard of the four permanent ballast tanks 11, 21, 31, 41; four temporary ballast tanks 13, 23, 33, 43 are located at the base of the columns 1, 2, 3, 4, respectively; the three central tanks are the base center tank 5, the wing tank east 6, and the wing tank west 7. However, the ballast/de-ballast system and method may be used with other vessels or TLP arrangements.

Figure 2:
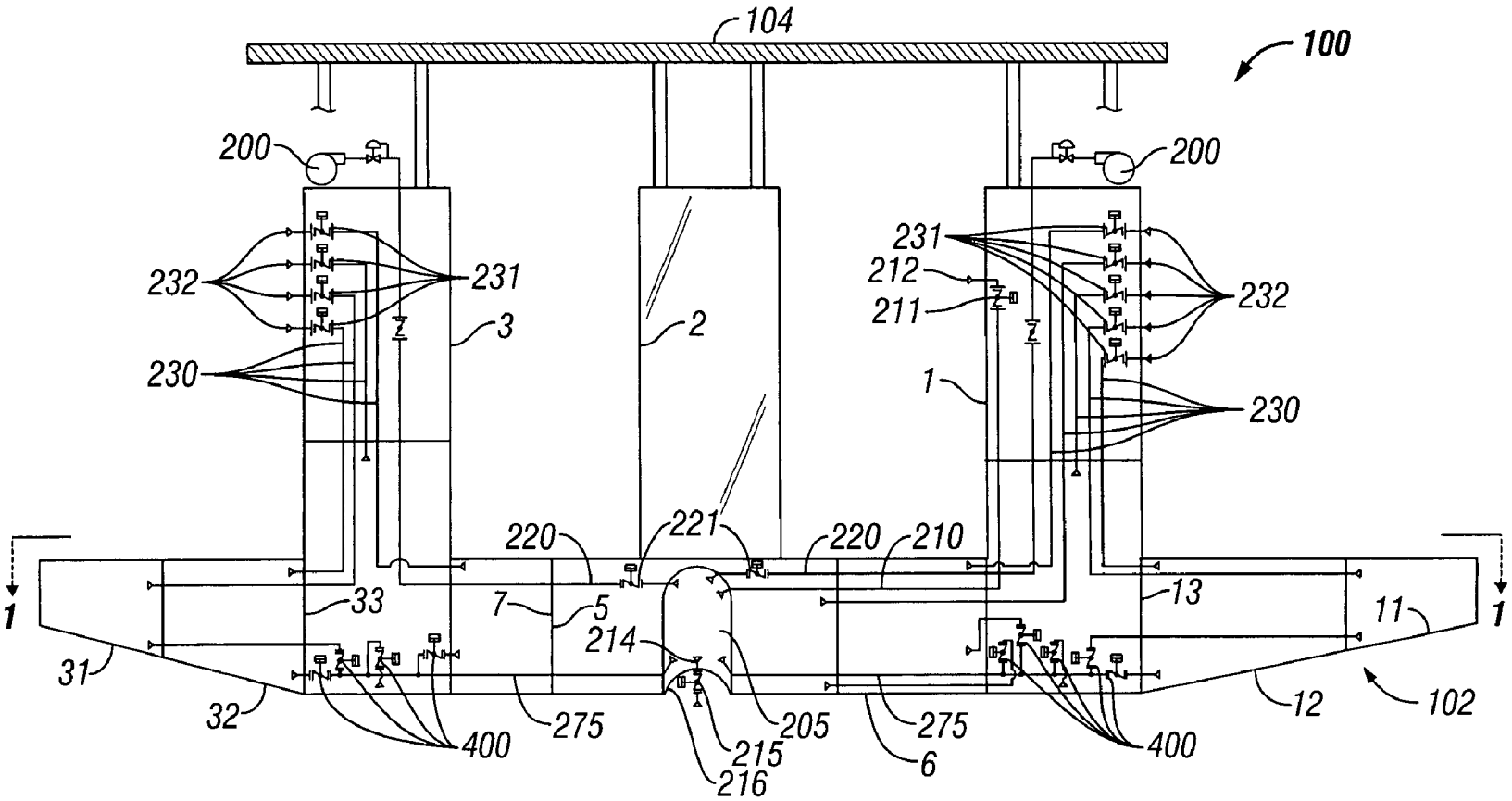
FIG. 2 is a side view cross section of the TLP taken along the lines 2—2 of FIG. 1.

As shown in FIG. 2, the first embodiment uses a source of compressed gas 200 and a pressure tank 205 contained in the hull 102. The pressure tank 205 vents to atmosphere via a pressure tank vent fluid path 210, a pressure tank vent isolation valve 211, and a pressure tank vent overboard discharge fitting 212. The pressure tank 205 is also fluidly coupled to a sea chest 216 via a sea chest fluid path 214 and sea chest isolation valve 215. The pressure tank 205 has a compressed gas fluid path 220 connected to the source of compressed gas 200 and containes a gas isolation valve 221 for pressurizing tank 205. Preferably, one or more high capacity air compressors 200 supply the compressed gas, although other suitable sources may be used. The pressure tank vent isolation valve 211, sea chest isolation valve 215, and compressed gas isolation valve(s) 221 are all preferably remotely operable. Pressure tank 205 is connected to the individual ballast compartments by a ballast flow path 275 and ballast compartment isolation valves 400. All ballast tanks 31, 32, 33, etc. are preferably separately vented to the atmosphere. For example, FIG. 2 shows each ballast tank 31, 32, 33, 7, 5, 6, 13, 12, 11 having a vent fluid path 230, an overboard discharge fitting 232, and a remotely operable vent isolation valve 231.

Referring to FIG. 2, the method for ballasting according to the first embodiment involves filling the pressure tank 205 with seawater and then pressurizing the pressure tank 205 with the source of compressed gas 200 to displace the seawater into a selected ballast compartment. For instance, if it is desired to fill ballast compartment 11, all manifold isolation valves 400 and gas supply valve(s) 221 are shut, and seawater isolation valve 215 and pressure tank vent isolation valve 211 are opened. Seawater enters pressure tank 205 through sea chest 216 and fluid path 214 under the influence of the sea water head. Once pressure tank 205 is filled with seawater, seawater isolation valve 215 and pressure tank vent isolation valve 211 are shut, and gas supply valve 221 is opened. The ballast compartment isolation valve 400 and vent isolation valve 232 corresponding with ballast compartment 11 are opened. The compressed gas displaces seawater in pressure tank 205 and forces it into ballast compartment 11. Although the ballast compartments may be filled by seawater solely by sea pressure as is pressure tank 205, providing pressure tank 205 with a source of compressed gas 200 allows ballasting of tanks which are elevated above sea level. The rate of ballasting is a function of the pressure tank 205 volume and the mass flow rate of gas supplied by gas source 200 for tank 205 evacuation.

Figure 3:
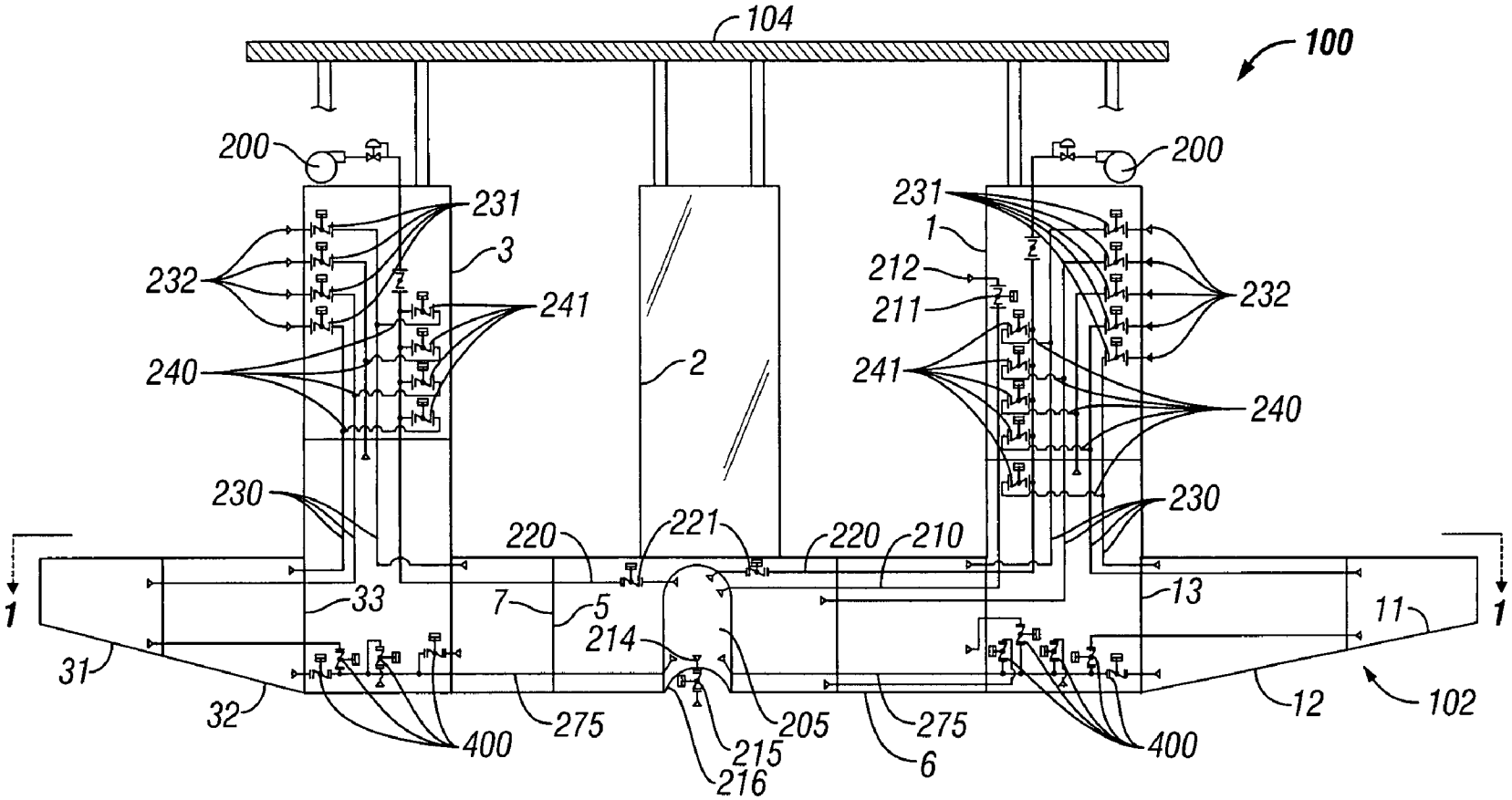
FIG. 3 is the side view cross section of the TLP of FIG. 2 showing the ballast system equipped with an optional secondary gas system for de-ballasting.

FIG. 3 illustrates one possible system for de-ballasting the vessel 100 of the first embodiment. The source of compressed gas 200 is optionally connected by secondary gas fluid paths 240 and secondary gas isolation valves 241 to the individual ballast compartments 31, 32, 33, etc. Portions of the secondary gas fluid paths 240 may be combined, if desired, with portions of the vent fluid paths 230. If it is desired to de-ballast compartment 11, for example, gas supply valve 221, pressure tank vent isolation valve 211, and the vent isolation valve 231 which corresponds to ballast tank 11 are shut, and sea chest isolation valve 215 and the ballast compartment isolation valve 400 which correspond to ballast tank 11 are opened. The secondary gas isolation valve 241 corresponding to ballast tank 11 is then opened. Compressed gas displaces the ballast, forcing it out sea chest 216 via manifold 275 and pressure tank 205.

Figure 4:
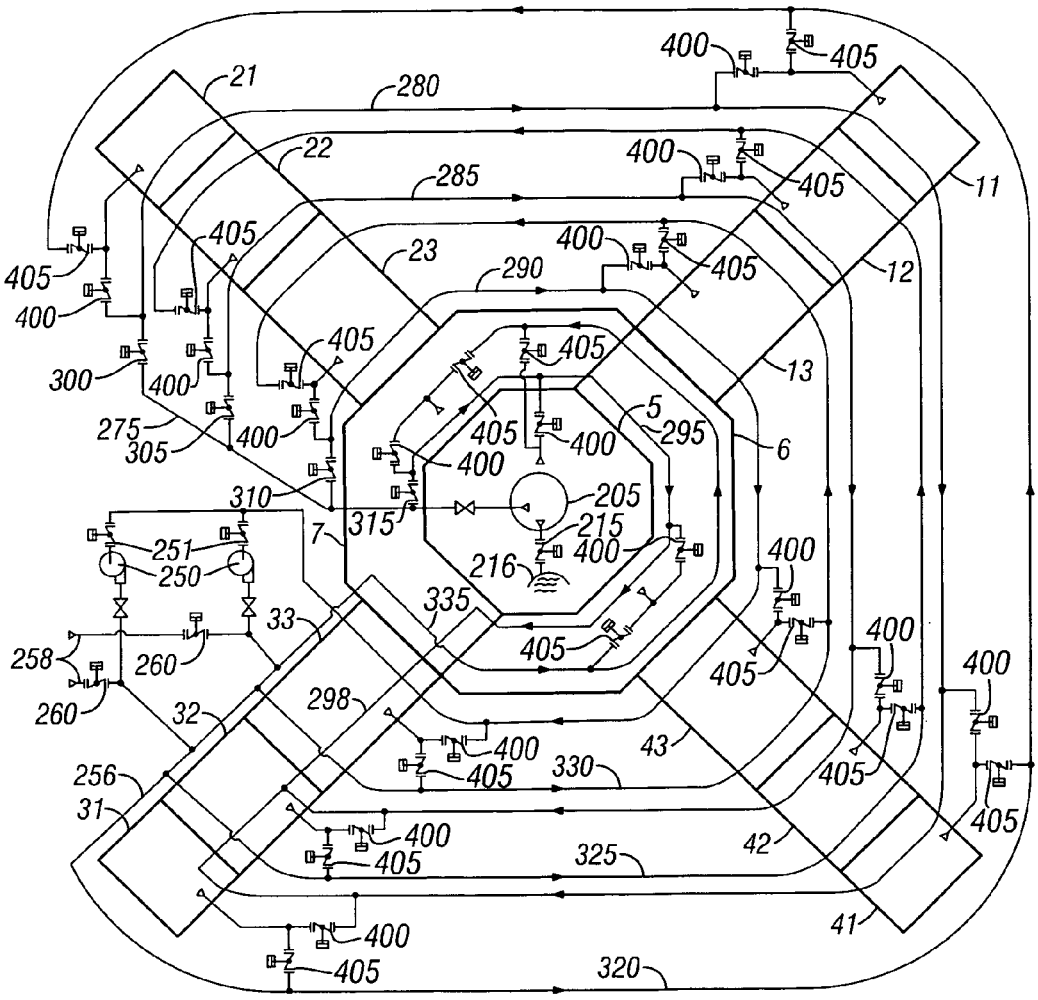
FIG. 4 is a schematic diagram showing the ballast system of FIG. 2 with an alternative optional bilge and ballast transfer system for de-ballasting according to the first embodiment of the invention.

FIG. 4 illustrates an alternative system and method for de-ballasting the vessel of the first embodiment. During ballasting, the pressure tank 205 supplies water as described above to a supply manifold 275 with four supply headers 280, 285, 290, 295. These supply headers 280, 285, 290, 295 subdivide the ballast tanks into four groups composed of opposing tanks in each quadrant and the center base segment 5, 6, 7. Each header preferably has an isolation valve 300, 305, 310, 315. Each ballast tank preferably has a ballast compartment isolation valve 400 for isolation of ballast flow. Header valves 300, 305, 310, 315 and ballast compartment isolation valves 400 are preferably remotely operable.

De-ballasting and ballast transfer between ballast tanks are preferably accomplished using optional moderate capacity centrifugal pumps 250 (see FIG. 4). The four individual supply headers 280, 285, 290, 295 are recombined in manifold 298 to supply the suction of the bilge and ballast transfer pumps 250. The discharges from the pumps 250 are preferably tied into a return manifold 256 that is fluidly coupled to the individual ballast tanks via four return headers 320, 325, 330, 335 and return isolation valves 405 for the individual ballast compartments for ballast transfer and also fluidly coupled to overboard discharge piping 258 through overboard discharge valves 260 for de-ballasting. Return isolation valves 405 and overboard discharge valves 260 are preferably remotely operable. For example, if it is desired to de-ballast compartment 11, all ballast compartment isolation valves 400 are shut except for the one corresponding to ballast tank 11. All return isolation valves 405 are shut. Manifold isolation valve 300 is shut. Pump 250 suction valve 251 and overboard discharge valve 260 are opened. Ballast compartment 11 is vented to atmosphere and the bilge and ballast transfer pump 250 is started, which empties the contents of compartment 11 overboard. Alternatively, if it desired to transfer ballast from ballast tank 11 to ballast tank 43, for example, the valve line-up is the same as above except that overboard discharge valve 260 is shut and the return isolation valve 405 corresponding to tank 43 is opened. Ballast tank 43 is vented to atmosphere. Pump 250 now transfers the contents of ballast compartment 11 to ballast compartment 43.

Figure 5:
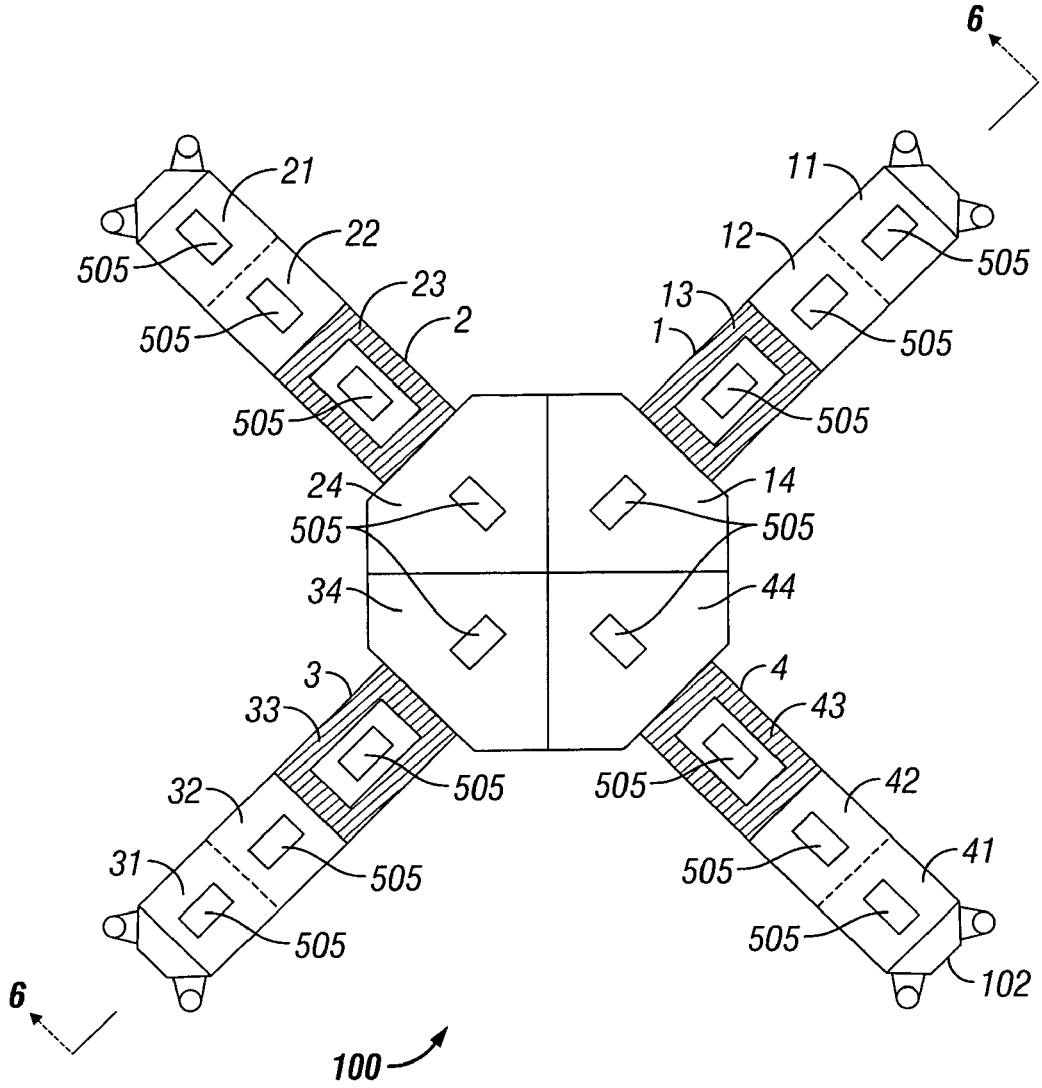
FIG. 5 is a top view cross section of a TLP viewed along the lines 5—5 of FIG. 6 showing the internal ballast tank structure of a typical TLP and individual ballast tank sea chests according to a second embodiment of the invention.

As shown in FIG. 5, a second embodiment the ballast and de-ballast system and method according to the invention is preferably employed in a tension leg platform (TLP) 100 having a hull 102 and a number columns 1, 2, 3, 4 extending upwardly therefrom and supporting a deck 104. The hull 102 has any number of internal ballast tanks but is illustrated with sixteen internal ballast tanks. There are four permanent ballast tanks 11, 21, 31, 41 that are the most outboard tanks in the hull 102. There are twelve tanks within the hull 102 used only temporarily for towing and installation of the TLP 100 to the tendons: Four of these temporary ballast tanks 12, 22, 32, 42 are located immediately inboard of the four permanent ballast tanks 11, 21, 31, 41; four temporary ballast tanks 13, 23, 33, 43 are located at the base of the columns 1, 2, 3, 4, respectively; and four tanks are central base tanks 14, 24, 34, 44. However, the ballast/de-ballast system and method may be used with other vessels or TLP arrangements.

Figure 6:
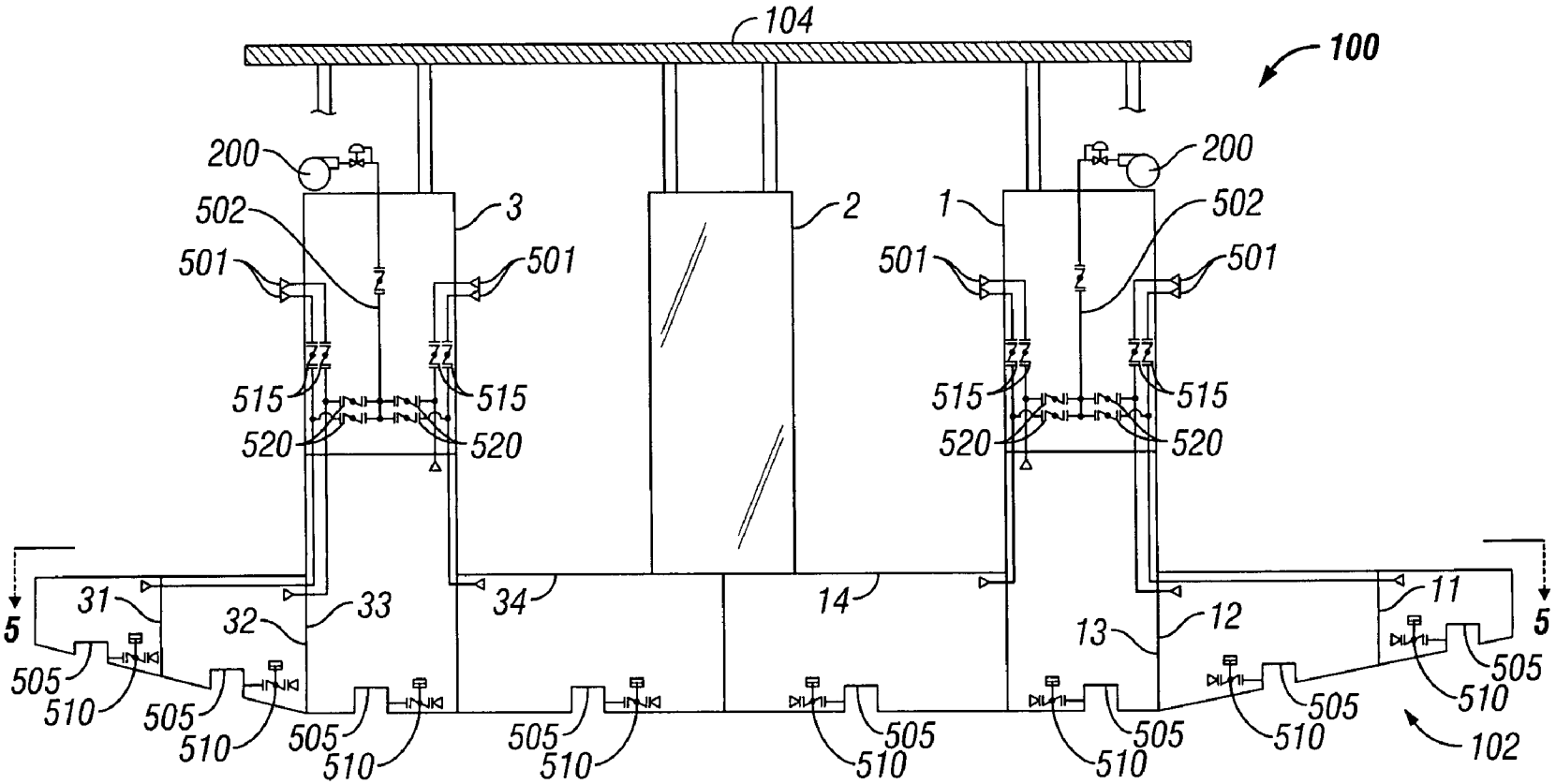
FIG. 6 is a side view cross section of the TLP taken along the lines 6—6 of FIG. 5.

Referring to FIG. 6, the second embodiment also includes a source of compressed gas 200, preferably comprising one or more high capacity air compressors. The source of compressed gas 200 is fluidly coupled to the various ballast tanks, 31, 32, 33, etc. by a compressed gas manifold 502 and individual gas isolation valves 520, which are in turn individually piped to the various ballast tanks. All ballast tanks 31, 32, 33, etc. are preferably separately vented to the atmosphere. For example, FIG. 6 shows each of several ballast tanks 31, 32, 33, 34, 14, 13, 12, 11 having a vent fluid path 514 (a portion of which is combined with the compressed gas piping), an overboard discharge fitting 501, and a vent isolation valve 515. The vent isolation valves 515 and the gas isolation valves 520 may be remote operable. Each ballast tank 31, 32, 33, etc., is preferably equipped with a sea chest 505 therein. The sea chest 505 is isolated with a valve 510, which is preferably remotely-operable.

Ballasting is accomplished by opening the vent valve 515 and the sea chest valve 510 associated with a given ballast tank. The sea pressure present at the sea chest will then cause flooding of the tank. The rate of ballasting is determined by the fluid resistances of the vent line, the sea chest line and the sea pressure (or draft).

For a given ballast tank, de-ballasting is performed by shutting the corresponding vent valve 515 and by opening the corresponding compressed air supply valve 520 and the corresponding sea chest valve 510. Provided the compressed air is maintained at a pressure exceeding sea pressure at the keel, the air will enter the ballast tank and displace the water overboard through the sea chest 505. The de-ballasting rate is determined by the fluid resistance of the sea chest line and the air mass flow rate. After TLP installation is complete, the sea chests 505 within the temporary ballast tanks are preferably sealed off. Although de-ballasting is described with ballast compartments located below the waterline voiding out of sea chests 505, ballast compartments located above the water line (not shown) may similarly have side shell valves and overboard discharge ports fluidly coupled to lower locations in the ballast compartments for rapidly draining the tanks by compressed gas or under atmospheric/near-atmospheric pressure.

Figure 7:
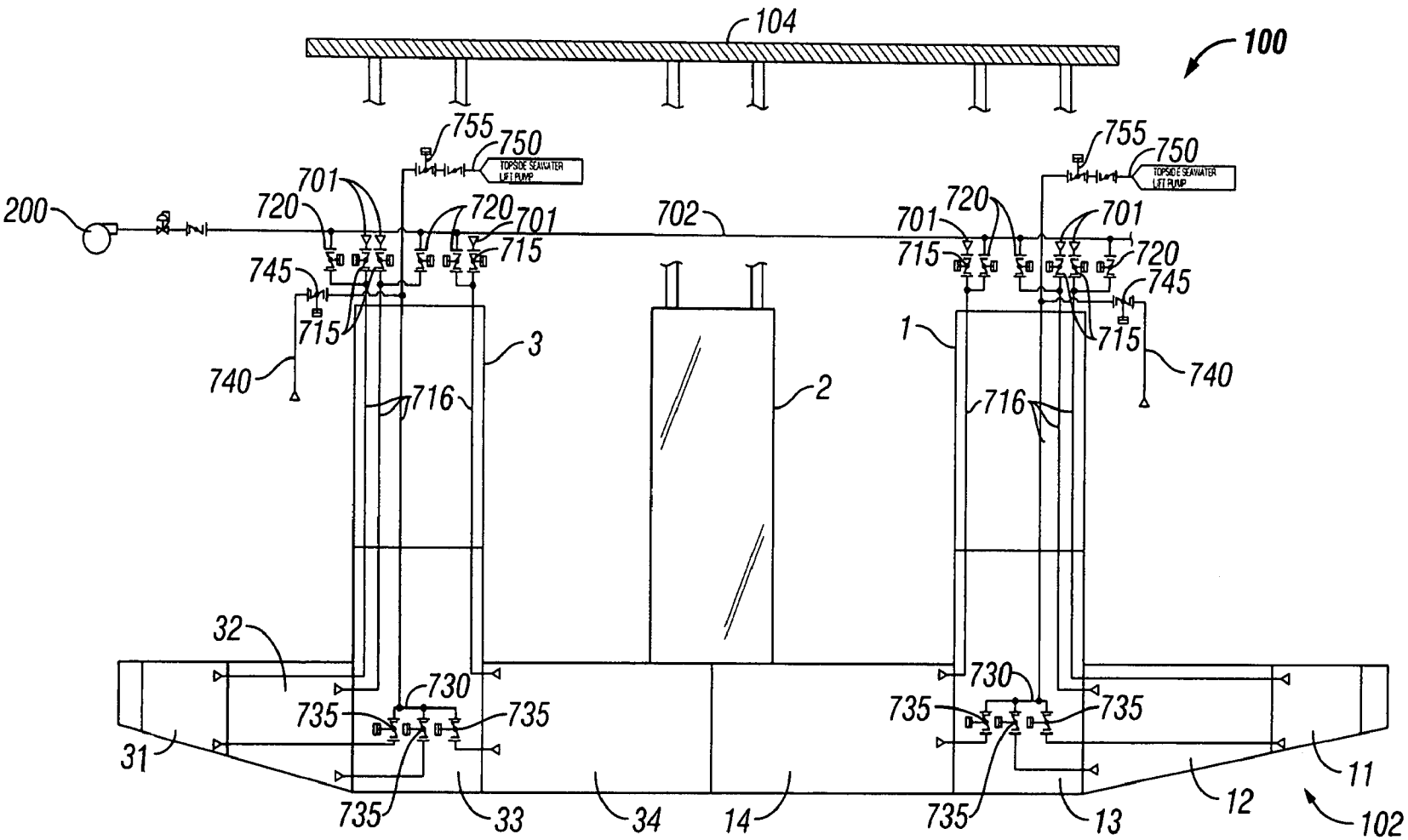
FIG. 7 is a side view cross section of a typical TLP showing a third embodiment according to the invention wherein the source of ballast may include fire main or seawater lift pumps, for example.

FIG. 7 illustrates a third embodiment of the invention. In this system, ballasting and de-ballasting occur through a ballasting manifold system 730 rather than through individual sea chests. The ballasting manifold 730 is preferably located near the keel level. The ballasting manifold 730 is fluidly coupled to the individual ballast tanks 11, 12, 14, 31, 32, 34 with ballast compartment isolation valves 735 connected therebetween for selective isolation. The ballasting manifold 730 is also fluidly coupled to an overboard discharge line 740 with an overboard discharge valve 745 connected therein to allow isolation, and the ballasting manifold 730 is fluidly coupled to a topsides seawater main 750 by seawater isolation valve 755. Each ballast tank is preferably individually vented to atmosphere through discharge openings 701, vent isolation valves 715, and vent piping 716. A compressed gas header 702 ties into tank vents with gas isolation valves 720. A source of compressed gas 200, preferably a high capacity air compressor, is connected to each ballast tank, preferably by the compressed gas header 702, which in turn is preferably tied into the vent piping 716 somewhere between the ballast compartment and the vent isolation valve 715. The source of compressed gas 200 is selectively isolated from the ballast compartments by gas isolation valves 720. The ballast compartment isolation valves 735, overboard discharge valve(s) 745, seawater isolation valve(s) 755, vent isolation valves 715, and gas isolation valves 720 are all preferably remotely operable.

For a given ballast tank, ballasting is accomplished by opening the corresponding vent valve 715, the corresponding ballast compartment isolation valve 735, and the topside seawater isolation valve 755. The corresponding air supply valve 720 is shut. Ballast water, supplied via the topsides seawater main 750 by firewater pumps, topside seawater lift pumps, or other source of water, fills the ballast tank. The rate of ballasting is a function of the mass flow rate from the supply pump(s).

For a given ballast tank, de-ballasting is performed by shutting seawater isolation valve 755 and the corresponding vent isolation valve 715, and by opening overboard discharge valve 745, the corresponding ballast compartment isolation valve 735, and the corresponding air supply valve 720. Provided the air supply pressure is maintained greater than the discharge line head, ballast water will be displaced overboard via the overboard discharge line 740. The de-ballast rate is a function of fluid resistance of the overboard discharge manifold and the air mass flow rate.

The ballasting/de-ballasting system and method according to one or more embodiments of the invention may limit the tendency for the locking mechanisms or slip mechanisms to ratchet when the tendons are about to be engaged during TLP installation by rapidly de-ballasting the vessel in order to quickly attain the required tendon tensions for tendon lock-off. For example, in ballast compartments located below the waterline, sea chest isolation valve(s) are opened while compressed gas is used to rapidly empty the flooded tanks, and in ballast compartments located above the waterline, sideshell or overboard discharge valves allow rapid discharge of ballast water under atmospheric or near atmospheric pressure. The rapid de-ballasting minimizes ratcheting of the locking mechanisms.

While some embodiments of the invention have been illustrated in detail, the invention is not limited to the embodiments shown; it is apparent that modifications and adaptations of the above embodiments may occur to those skilled in the art. Such modifications and adaptations are in the spirit and scope of the invention as set forth herein:

What is claimed is:

1. A method for de-ballasting a body (100) floating in a sea comprising the steps of, providing fluid communication between a lower internal location in a ballast tank (11) disposed in a hull (102) of said body to an exterior of said body, providing fluid communication between said ballast tank with a source of compressed gas (200), and displacing liquid ballast in said ballast tank to said sea by said compressed gas, wherein the step of providing fluid communication between a lower internal location in a ballast tank to an exterior of said body further comprises the step of opening a valve connected for fluid communication between said lower internal location in said ballast tank and a sea chest carried by said hull externally of said ballast tank below the waterline and in open communication with said sea.

2. The method of claim 1 further comprising the step of, fluidly coupling a pressure tank (205) between said water inlet valve and said sea chest.

3. The method of claim 1 wherein, said step of opening a valve is performed by remote actuation.

4. The method of claim 1 wherein the step of providing fluid communication between a lower internal location in a ballast tank to an exterior of said body further comprises the step of, opening a valve (735) connected for fluid communication between said lower internal location in said ballast tank and an overboard discharge (740) which exits said body at a point above the waterline.

5. A method for ballasting a vessel (100) floating an a sea comprising the steps of, venting an upper location within a ballast tank (11) disposed in a hull (102) of said vessel to an exterior of said vessel, filling a pressure tank (205) with a liquid ballast, coupling fluidly said pressure tank to a source of compressed gas (200), coupling fluidly a lower location within said pressure tank to said ballast tank, and then transferring said liquid ballast in said pressure tank to said ballast tank by displacement with said compressed gas.

6. The method of claim 5 wherein the step of coupling fluidly a lower location within said pressure tank to said ballast tank further comprises the steps of, opening a ballast compartment isolation valve (400) connected in fluid communication between said ballast tank and said lower location within said pressure tank.

7. The method of claim 6 wherein, said step of opening a ballast compartment isolation valve is performed by remote actuation.

8. A ballasting and de-ballasting system for a vessel (100) floating in a sea and comprising a hull (102) having a watertight ballast compartment (11), the ballasting and de-ballasting system comprising, a source of compressed gas (200) disposed in said vessel, a gas fluid path connected between said source of compressed gas and said ballast compartment, gas isolation valve connected in said gas fluid path, a ballast fluid path connected between a bottom location within said ballast compartment and a sea chest carried by said hull opening to an exterior of said vessel below the waterline, said sea chest disposed outside of said ballast compartment, an isolation valve connected in said ballast fluid path, wherein said ballasting and de-ballasting system is designed and arranged such that gas from said source of compressed gas via said gas fluid path may be used to displace liquid ballast in said ballast compartment to said exterior via said ballast fluid path for de-ballasting said vessel.

9. The ballasting and de-ballasting system of claim 8 further comprising, a ballast compartment vent fluid path connected between an upper location within said ballast compartment and a first overboard discharge which opens to said exterior of said vessel at a location above the waterline, and a ballast compartment vent isolation valve connected in said ballast compartment vent fluid path, wherein said ballasting and de-ballasting system is designed and arranged such that liquid ballast from said sea via said ballast fluid path may be used to displace gas in said ballast compartment to said exterior via said ballast compartment vent fluid path for ballasting said vessel.

10. The ballasting and de-ballasting system of claim 9 further comprising, a pressure tank (205) disposed in said hull outside of said ballast compartment, said pressure tank connected in said ballast fluid path between said isolation valve (400) and said sea chest (216), said pressure tank connected in said gas fluid path (220) between said gas isolation valve(221) and said ballast compartment, the gas fluid path between said pressure tank and said ballast compartment combined with the ballast fluid path between said pressure tank and said ballast compartment to form a common fluid path (275) having said isolation valve (400) connected therein, a sea chest isolation valve (215) connected in said ballast fluid path (214) between said pressure tank and said sea chest, a pressure tank vent fluid path (210) connected between an upper location within said pressure tank and a second overboard discharge (212) which opens to said exterior at a location above the waterline, and a pressure tank vent isolation valve (211) connected in said pressure tank vent fluid path, wherein said ballasting and de-ballasting system is designed and arranged such that liquid ballast from said sea via said ballast fluid path (214) between said sea chest (216) and said pressure tank (205) may be used to displace gas in said pressure tank to said exterior via said pressure tank vent fluid path (210) and such that gas from said source of compressed gas (200) via the gas fluid path (220) between said source of compressed gas and said pressure tank may be used to displace liquid ballast in said pressure tank to said ballast compartment via the common fluid path (275) for ballasting said vessel.

11. The ballasting and de-ballasting system of claim 10 further comprising, a secondary gas fluid path (240) connected between said source of compressed gas and said ballast compartment, said secondary gas fluid path bypassing said pressure tank (205) and said common fluid path (275), and a secondary gas isolation valve (241) connected in said secondary gas fluid path, wherein said ballasting and de-ballasting system is designed and arranged such that gas from said source of compressed gas via said secondary gas fluid path may be used to displace liquid ballast in said ballast compartment to said exterior via said common fluid path (275) for de-ballasting.

12. The ballasting and de-ballasting system of claim 10 further comprising, a plurality of ballast compartments (11, 12, 13) each having an associated ballast compartment isolation valve (400) fluidly coupled to a lower location therein, each said ballast compartment isolation valve fluidly coupled to a lower location in said pressure tank (205).

13. A ballasting and de-ballasting system for a body (100) floating in a sea and comprising a hull (102), the ballasting and de-ballasting system comprising, a first watertight ballast compartment (11) disposed in said hull, a sea chest carried by said hull externally of said first ballast compartment and opening to an exterior of said body below the waterline, a source of compressed gas (200) disposed in said body, an isolable first gas fluid path connected between said source of compressed gas and said first ballast compartment, an isolable first ballast fluid path connected between a bottom location within said first ballast compartment and said sea chest, wherein said ballasting and de-ballasting system is designed and arranged such that gas from said source of compressed gas via said first gas fluid path may be used to displace liquid ballast in said first ballast compartment to said exterior via said first ballast fluid path for de-ballasting said body.

14. The ballasting and de-ballasting system of claim 13 further comprising, an isolable first ballast compartment vent fluid path connected between an upper location within said first ballast compartment and a first overboard discharge which opens to said exterior of said body at a location above the waterline, wherein said ballasting and de-ballasting system is designed and arranged such that liquid ballast from said sea via said first ballast fluid path may be used to displace gas in said first ballast compartment to said exterior via said first ballast compartment vent fluid path for ballasting said-body.

15. The ballasting and de-ballasting system of claim 14 further comprising, a transfer tank (205) disposed in said hull outside of said first ballast compartment, said transfer tank connected in said first ballast fluid path, a sea chest isolation valve (215) connected in said first ballast fluid path (214) between said transfer tank and said sea chest, a first lower isolation valve connected in said first ballast fluid path between said transfer tank and said first ballast compartment, and an isolable transfer tank vent fluid path (210) connected between an upper location within said transfer tank and said exterior at a location above the waterline.

16. The ballasting and de-ballasting system of claim 15 wherein, said transfer tank is connected in said first gas fluid path (220) between said source of compressed gas and said first ballast compartment, the portion of the first gas fluid path between said transfer tank and said first ballast compartment and the portion of the first ballast fluid path between said transfer tank and said first ballast compartment defining a common fluid path (275) having said first lower isolation valve (400) connected therein, wherein said ballasting and de-ballasting system is designed and arranged such that liquid ballast from said sea via the portion of said first ballast fluid path (214) between said sea chest (216) and said transfer tank (205) may be used to displace gas in said transfer tank to said exterior via said transfer tank vent fluid path (210) and such that gas from said source of compressed gas (200) via the portion of the first gas fluid path (220) between said source of compressed gas and said transfer tank may be used to displace liquid ballast in said pressure tank to said first ballast compartment via the common fluid path (275) for ballasting said body.

17. The ballasting and de-ballasting system of claim 13 further comprising, a second watertight ballast compartment (12) disposed in said hull so that said sea chest is located externally of said second ballast compartment, an isolable second gas fluid path connected between said source of compressed gas and said second ballast compartment, an isolable second ballast fluid path connected between a bottom location within said second ballast compartment and said sea chest, and an isolable second ballast compartment vent fluid path connected between an upper location within said second ballast compartment and said exterior of said body at a location above the waterline.

* * * * *